US005228373A

United States Patent [19]

Welsch

[11] Patent Number: 5,228,373

[45] Date of Patent: Jul. 20, 1993

[54] METHOD AND APPARATUS USING ELECTROSTATIC CHARGES TO TEMPORARILY HOLD PACKETS OF PAPER

[75] Inventor: Bernhard J. Welsch, Waverly, Ohio

[73] Assignee: Robert A. Foisie, Carson City, Nev.

[21] Appl. No.: 750,612

[22] Filed: Aug. 27, 1991

Related U.S. Application Data

[62] Division of Ser. No. 462,140, Jan. 8, 1990, Pat. No. 5,062,764.

[51] Int. Cl.[5] ..... B65H 29/14; B65H 35/08

[52] U.S. Cl. ..... 83/24; 83/29; 83/37; 83/155; 83/701; 271/208; 361/214; 361/222; 414/786; 414/788

[58] Field of Search ..... 271/193, 208, 18.1, 271/207, 217; 361/214, 212, 225, 230, 233, 220, 221, 222; 414/786, 788, 788.1, 792.7, 792.8; 83/24, 29, 37, 155, 701

[56] References Cited

U.S. PATENT DOCUMENTS

| | | | |
|---|---|---|---|
| 3,670,203 | 6/1972 | Whitmore et al. | 361/214 X |
| 3,726,520 | 4/1973 | Doi . | |
| 3,735,198 | 5/1973 | Barnett et al. . | |
| 3,826,379 | 7/1974 | Wright | 271/208 |
| 3,865,480 | 2/1975 | Swanberg | 271/207 X |
| 3,892,614 | 7/1975 | Levy . | |
| 3,973,770 | 8/1976 | Montebruck . | |
| 4,012,033 | 3/1977 | Parrish | 271/193 X |
| 4,189,133 | 2/1980 | Arrasmith et al. | 271/217 X |
| 4,380,037 | 4/1983 | Harris | 361/214 |
| 4,486,808 | 12/1984 | Cardone | 361/214 X |
| 4,949,950 | 8/1990 | Stephany | 271/193 |
| 4,951,935 | 8/1990 | Oikawa | 271/208 |
| 5,064,180 | 11/1991 | Wingate | 271/193 X |

FOREIGN PATENT DOCUMENTS

| | | | |
|---|---|---|---|
| 2100980 | 8/1972 | Fed. Rep. of Germany | 271/193 |

OTHER PUBLICATIONS

Chargemaster, Julle Associates, Inc. Nov., 1985.

*Primary Examiner*—Michael S. Huppert
*Assistant Examiner*—Janice Krizek
*Attorney, Agent, or Firm*—Ware, Fressola, Van Der Sluys & Adolphson

[57] ABSTRACT

In a paper processing machine, the method and apparatus of this invention apply an opposite electrostatic charge to stacks and reams of paper to eliminate the repelling force from like charges on both sides of the individual sheets of the stack or ream to thereby temporarily bond them together. With the sheets thus temporarily bonded, the stacks and reams of paper can be easily transported between work stations without undesirable sliding of the sheets.

16 Claims, 4 Drawing Sheets

METHOD AND APPARATUS USING ELECTROSTATIC CHARGES TO TEMPORARILY HOLD PACKETS OF PAPER

This is a divisional of copending U.S. patent application Ser. No. 07/462,140 filed on Jun. 8, 1990, now U.S. Pat. No. 5,062,764.

BACKGROUND OF THE INVENTION invention relates to moving and transporting stacks of paper and similar materials, and more particularly to the deliberate use of electrostatic charges to pin sheets of paper together in a stack which can then be easily transported and stored.

Electrostatic forces on webs or sheets of paper often interfere with the operation of paper converting machinery. These charges are of opposing polarity so that one side of the continuous web is of positive polarity while the other side is of negative polarity. This causes the web to be attracted to machinery components or to adjacent webs (in case of multiple web processing with webs being unwound from several mill rolls, or when a single web is slit into ribbons which are then superimposed in the processing machine for further processing). Once sheeted, the webs are then stacked onto skids up to about six or seven feet high. The skid loads are then transported by fork-lifts to a temporary storage area or moved directly to the next processing machine such as a destacker and cartonizing machine manufactured and sold by Involvo, 33 Brook Street, West Hartford, Conn.

In order to prevent machine jam-ups due to sheets clinging together from the time they are cut from the endless web until they are stacked at the delivery end of the sheeter, great care is taken to avoid or eliminate electro-static charges between the paper layers. This facilitates the flow of the cut sheets into the delivery stack at the sheeter. As the endless web (ribbons) advances from the unwind roll through pull roller systems before and after the printing stations and through the printing stations, it comes in contact with metal rollers or metal cylinders on one side and rubber or plastic covered rollers or cylinders on the other. Typical examples are: (1) driven steel pull rollers on one side of the web and rubber or plastic covered nipper wheels (or nipper rollers) on the other; (2) rubber covered impression cylinder on one side of the web and a metal gravure cylinder on the other (in gravure presses); and (3) rubber covered blanket cylinder on one side and steel impression cylinder on the other side (in web offset presses). While passing through the nips of such cylinders or rollers of different materials on each side of the web, the electrostatic charges on the paper surfaces are altered and may add to or subtract from the already existing electrostatic charge on that side of the paper and thereby cause an imbalance that interferes with the high speed operation of the paper processing machine.

The prior art teaches the use of static eliminators to neutralize the electrostatic charges on both sides of the webs to reduce or eliminate jam-ups and other interference with the free flow of the still endless paper webs (or ribbons). The simplest method of prior art is the use of metal tinsel connected to ground and with the free ends of the tinsel touching the moving web.

Other prior art methods for eliminating undesired electrostatic charges from moving webs of paper and similar materials include the use of the nuclear static eliminators, air ionizing devices or static eliminator rods. These devices are commercially available and will effectively neutralize the static charges on a moving web or sheet of paper and thus eliminate the undesired clinging together of webs or sheets and their undesired attraction to machinery components or to each other. Eliminating these electrostatic charges causes the sheets to repel each other in a manner similar to that of magnetic poles having like charges. In addition to this, a boundary layer of air remains between several of the uppermost sheets on the stack, such that these sheets slide easily around when the stack is moved such as during transport by fork-lifts. The boundary layer of air is squeezed out between the lower layers when the weight of the sheets accumulated on top exceeds the repelling force from the like charges between the layers of paper plus the force required to move the boundary layer of air. Normal friction then prevents the lower sheets in the stack from sliding, while the upper sheets still are free to slide around.

When the skid loads of paper are moved, the uppermost sheets have a tendency to slide off, fall down to the floor where they are spoiled. This is particularly severe when handling sheets having the so-called "Kromekote" surfaces which are very smooth (very low coefficient of friction) and contain chemicals having a very high dielectric constant (such as the titanates). Kromekote" sheets (coated on both sides) and having a thickness of 0.008 to 0.010 inches and a sheet size of about 23×35 inches sell for approximately one U.S. dollar ($1.00) per sheet wholesale so that the loss of a few sheets from each stack at the paper processing plant could be substantial.

Additionally, when the skid loads of paper stacks are automatically destacked on the INVOLVO destacker, the uppermost sheets of the individual reams being destacked again slide around and cause undesirable trouble until the reams are cartonized. This occurs because the weight has been removed and the charges of like polarity again want to levitate the upper sheets. The faster the machine runs, the more disturbance there is. This then limits the production speed of the machine to well below the rated mechanical speed.

SUMMARY OF THE INVENTION

The present invention is designed to overcome the above noted limitations that are attendant in the "prior art" and toward this end it contemplates the provision of a novel method and apparatus for deliberately inducing electrostatic charges of opposite polarities into stacks of sheets of paper in order to hold them together during transport.

An object of this invention is the deliberate application of an electrostatic charge having a polarity opposite to the charge existing in the pile (or stack) to neutralize the repelling force between the uppermost layers, allowing their weight to push out the entrapped layers of air and thereby to cause intimate contact between the sheets of paper so that the normal coefficient of friction is restored and the undesired slippage eliminated.

Another object is to provide a method and apparatus which induces electrostatic charges of opposite polarity in individual stacks of paper being destacked from skid loads of paper for cartonizing.

It is a further object to provide such a method which can be easily practiced using automated machinery.

Still another object is to provide such an apparatus which may be readily and economically fabricated and will enjoy a long life and operation.

It has now been found that the foregoing and related objects can be readily attained in an apparatus using electrostatic charges to temporarily hold sheets of paper in assembly which assembles a skid load stack of sheets of paper with each sheet having an electrostatic charge introduced thereon which tends to repel the sheet from adjacent sheets in the skid load stack. In addition, as the skid load stack is assembled, a layer of air is introduced between adjacent sheets whereby the electrostatic forces and layers of air cause adjacent sheets to slide relative to one another if the skid load stack is moved. By introducing an opposite electrostatic charge into at least an upper portion of the skid load stack, the opposite electrostatic charge having an opposite polarity to the electrostatic charge introduced during the assembly step, the sheets in the upper portion of the skid load stack are caused to attract to one another thereby decreasing the tendency of the sheets in the upper portion to slide relative to one another if the skid load stack is moved.

During further processing, predetermined numbers of sheets from the skid load are separated to form individual stacks of sheets. An electrostatic charge of opposite polarity to the existing electrostatic charge in the lower portion sheets is introduced thereby causing the sheets in the individual stacks to attract to one another thereby decreasing the tendency of the sheets to repel one another. The individual stacks can then be moved for further processing.

Desirably, to introduce the opposite electrostatic charge, an electrostatic charging device is provided adjacent a path along which the individual stacks of sheets pass. The electrostatic charging device can be moved relative to the individual stacks by a computer controller to optimize the distance between the electrostatic charging device and the top of the individual stacks.

The invention will be fully understood when reference is made to the following detailed description taken in conjunction with the accompanying drawings.

DETAILED DESCRIPTION OF THE PREFERRED EMBODIMENT

Figure 1:
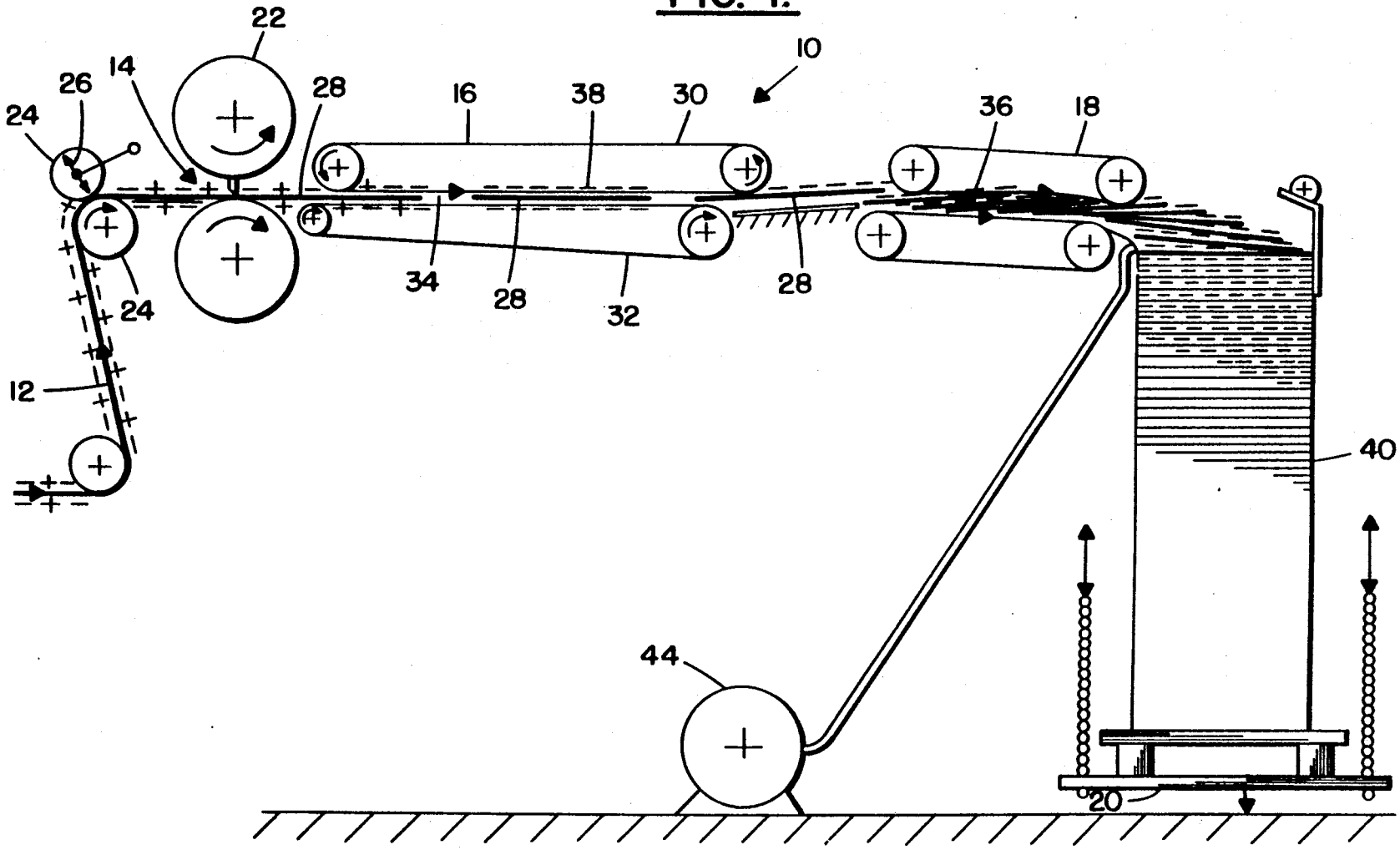
FIG. 1 is a schematic side elevational view of the delivery end of a paper converting machine in which sheets are cut from an endless web and stacked in a pile delivery or other stack forming device.

Turning first to FIG. 1, therein illustrated is the delivery end of a paper converting machine generally indicated by the numeral 10 As a printed perforated, punched or otherwise processed endless web or ribbon of paper 12 moves toward the delivery end of the paper converting machine 10, it usually passes through a rotary sheeter section generally indicated by the numeral 14 where sheets are cut from the endless web 12 and moved through high speed and low speed conveyor belt sections, respectively indicated by the numerals 16 and 18, into a pile delivery or other stack forming device 20 for further in-line or off-line processing.

The rotary sheeter section 14 includes a rotary cutting knife device 22 upstream from a pair of nipper rollers 24, the upper of which is mounted for swinging movement as indicated by arrow 26. At the instant the rotary cutting knife 22 severs a sheet 28 from the leading end of the continuous web 12, web tension downstream of the continuous web 12 is lost and the nipper rollers 24 just upstream of the rotary cutter knife device 22 push the leading end of the web 12 beyond the rotary cutter knife device 22 and into the high speed belt section 16 with its upper and lower belts 30 and 32. The upper and lower belts 30 and 32 are staggered across the web 12 so that they can be adjusted to make contact with the leading end of the web 12 and pull it forward. The surface speed of these belts is considerably higher than the speed of the moving web 12 for several reasons. First, the belts 30 and 32 pull the web 12 taught to allow cutting under tension. Secondly, they quickly move the cut sheet 28 away from the endless web 12 as soon as the rotary cutter knife device 22 has severed it from the continuous web 12. Finally, they create a space 34 between successive cut sheets so as to facilitate overlapping (shingling) of cut sheets as indicated by numeral 36 in the slow speed belt section 18 further downstream. Since the high speed belts 30 and 32 have rubber or plastic surfaces which rub on the slower speed leading end of the continuous web 12 until the sheets have been cut and accelerated to the higher belt speed, electrostatic charges of the same negative polarity 38 are being generated on both sides of the just cut sheet 28.

As the spaced apart sheets 28 coming from the high speed belt section 16 move into the low speed belt section 18, the low speed belts rub on both sides of the sheets to cause them to slow down, and the sheets partially slide over each other as shown by numeral 36. This increases the electrostatic forces 38 of negative polarity on both sides of the sheets. Since the charge on the lower side of the upper sheet is of the same polarity as the charge on the top side of the next lower sheet, the sheets are being repelled by the electrostatic forces and a thin layer of air is permitted to stay between the sheets. No effort is made to remove the electrostatic forces of same polarity because they facilitate the sliding of the sheets over each other as they form a pile or a stack in the stacking device 20. The stack can form a skid load 40 up to about six feet (6') high. Often air blasts from a compressor 44 are deliberately introduced to enhance the floating of the sheets into the pile or stack. When the pile or stack builds up sufficiently, the weight of the upper sheets in the pile or stack overcomes the repelling force from the electrostatic charges of equal polarity and will push out some of the air entrapped between the lower sheets; however, the electrostatic forces remain in the accumulated pile or stack and cause problems when the skid load 40 is moved to an off-line, automatic destacking and cartonizing machine (FIG. 3) where reams of sheets are destacked from the skid load 40 and cartonized.

Depending upon moisture content, surface coatings and basis weight of the paper as well as the intensity of the electrostatic forces between the sheets, the weight of the upper ⅛" to 2" thick layers of sheets is often insufficient to overcome the repelling electrostatic forces existing between the upper sheets so that the boundary layers of air between the upper sheets are not pushed out. When the skid load 40 of paper is removed from the stacking device 20 to storage or further processing in the destacker/cartonizing machine, the upper sheets float around, get displaced, or even fall off. This results in costly damage and inefficiency.

Figure 2:
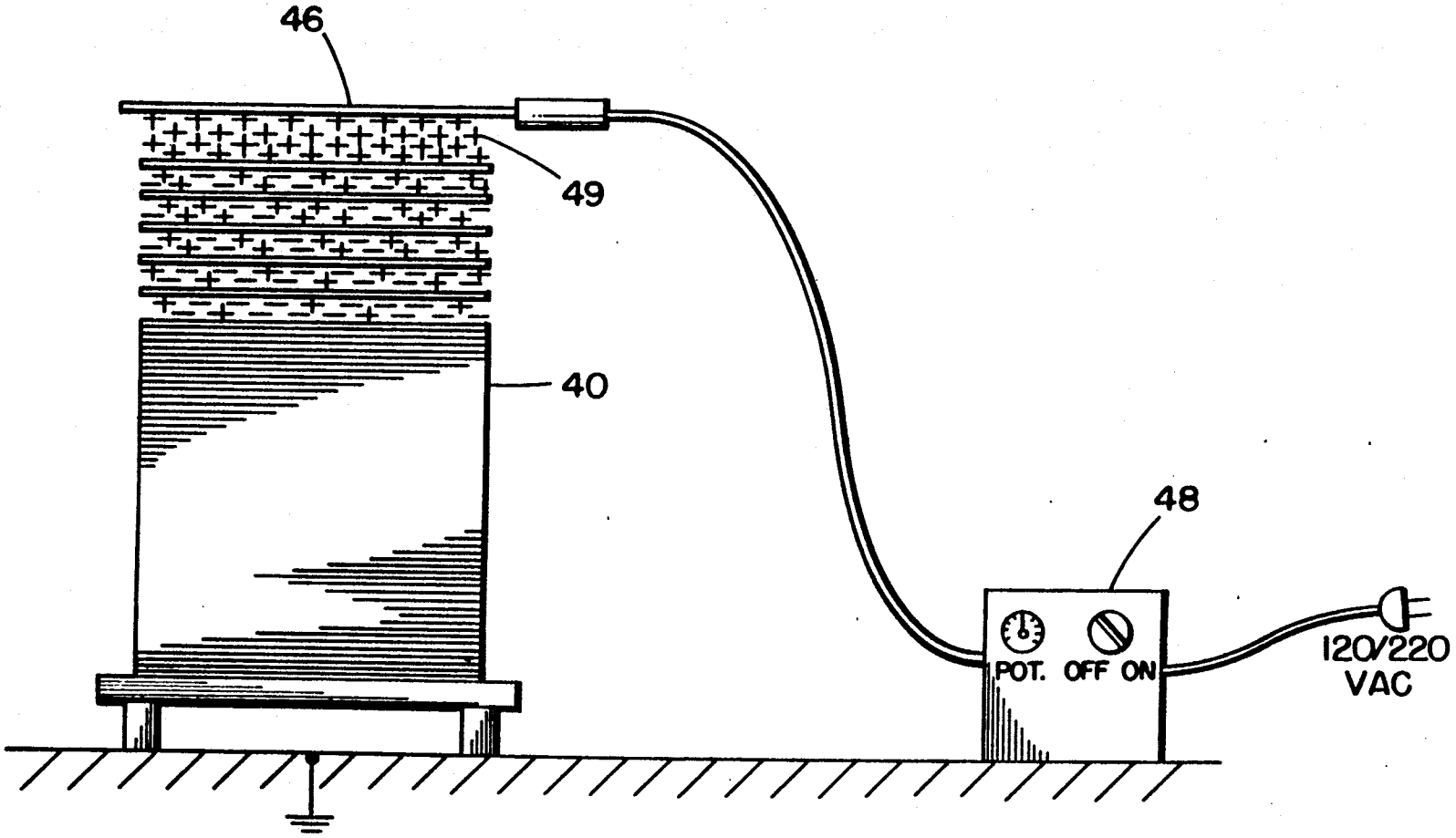
FIG. 2 is a schematic side elevational view of the electrostatic charge inducing method of the present invention being practiced on a skid load of paper produced by the machine of FIG. 1.

To neutralize the repelling force between the uppermost sheets of the skid load 40 before it is moved, an electrostatic emitting device 46, with its power pack 48, as shown in FIG. 2 is used to neutralize the repelling forces by deliberately applying an electrostatic charge 49 having a polarity opposite to the charge existing in the skid load 40. The weight of the uppermost sheets then pushes out the entrapped layers of air whereby intimate contact between the sheets is achieved allowing the normal friction therebetween to prevent undesired slippage.

The electrostatic emitting device 46 is a charging bar made by SIMCO, 2257 N. Penn Road, Hatfield, Pa. 19440 and described in U.S. Pat. No. 3,735,198, which is hereby incorporated by reference. It provides up to 25,000 volts, 8 mA. The depth of penetration varies depending upon the strength of the applied charge, the moisture content of the paper (conductivity), and the distance between the electrostatic emitting device 46 and ground (earth). After the application of the charge, the skid load 40 of paper can then be moved for further processing without the upper sheets sliding around or falling off. Since the deliberate application of electrostatic force penetrates only a short distance into the top of the pile, it does not neutralize the electrostatic force of opposite polarity further down in the pile.

Figure 3:
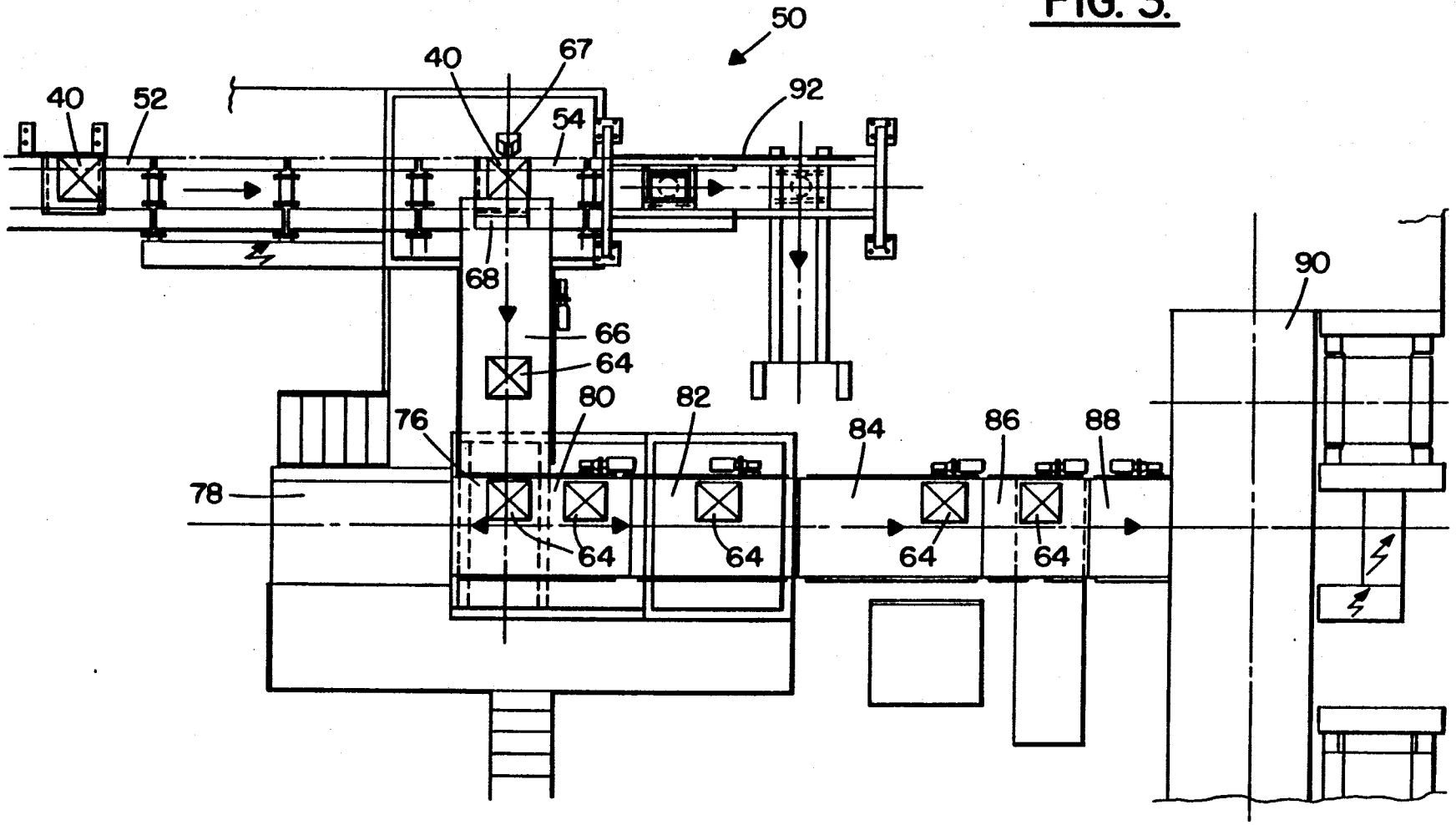
FIG. 3 is a schematic top elevational view of a destacker installation modified in accordance with the present invention to induce electrostatic charges of opposite polarity to individual stacks of paper being separated from a skid load of paper.
Figure 4:
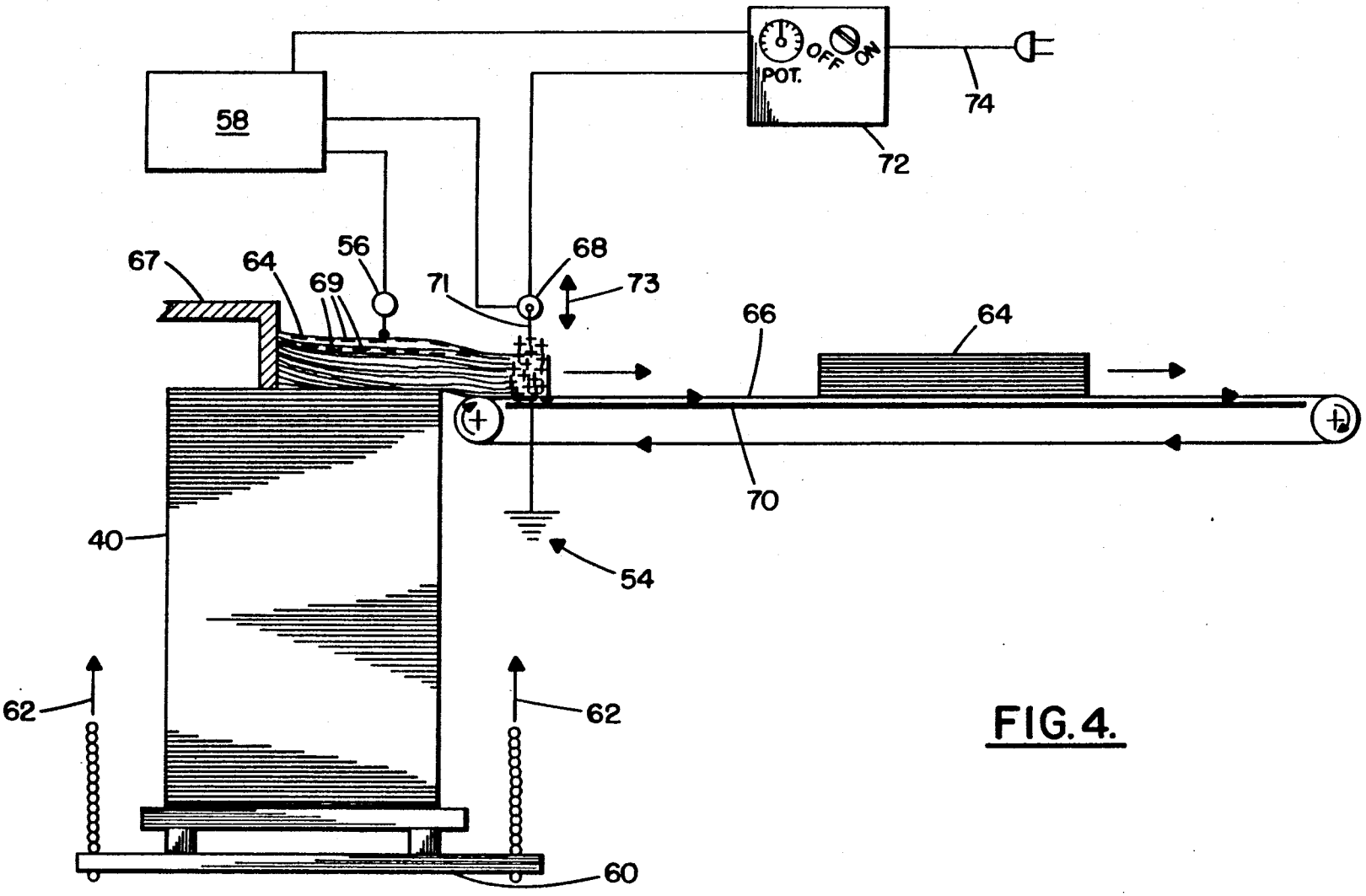
FIG. 4 is a schematic side elevational view of the destacking station of the destacker installation of FIG. 3.

Turning now to FIG. 3, therein is illustrated a destacking and cartonizing installation generally indicated by numeral 50 and modified in accordance with the present invention. The installation 50 is manufactured and sold by Involvo, 33 Brook Street, West Hartford, Conn. The skid load of paper 40 is placed onto an infeed conveyor 52 of the installation 50 and is automatically advanced to the destacker 54. At the destacker 54 as shown in FIG. 4, the total height of the skid load 40 is automatically sensed by a proximity switch 56 and the ream thicknesses of the proper sheet count are then computer calculated by a computer controller 58 in a well known manner. The computer controller 58 is a conventional microprocessor of the type generally found as original equipment in the Involvo destacking and cartonizing machine 50 which is programmed to perform the functions of the present invention. The computer controller 58 causes a lifting platform 60 holding the skid load 40 to be elevated as indicated by arrows 62 allowing reams 64 of the proper count to be automatically destacked and moved onto a conveyor belt 66 by a pusher 67. As the ream 64 is pushed off the skid load 40, the electrostatic charges 69 of equal polarity (still existing between the sheets of paper in the lower portion of the skid load 40 being destacked) reduce the friction between sheets allowing them to slide around under the slightest external force. To eliminate this problem, an electrostatic emitting device 68 is mounted at the beginning of the conveyor 66 emitting electrostatic charges 71 of positive polarity and moves automatically up or down as indicated by arrow 73 in accordance with a computer generated signal from the controller 58 corresponding to the height of the ream of paper 64 that is being passed underneath the electrostatic emitting device 68.

The electrostatic emitting device 68 is identical to the electrostatic emitting device 46 shown in FIG. 2 and has emitter points spaced ½ to 2 inches apart and positioned above the conveyor belt 66 close to the nearest edge of the skid load 40 in such a way that the ream 64 being destacked passes below the electrostatic emitting device 68. The tips of the emitter points are desirably no more than three inches above the top surface of the ream. The distance between the emitter tips and the top of the ream 64 is adjusted automatically as indicated by arrow 73 by the controller 58 to account for the thickness of the ream power pack 72 so as to keep this distance at a minimum for maximum efficiency. The actual movement indicated by arrow 73 can be accomplished by a servomotor or pneumatic cylinder with a position controller (not shown). Both the voltage applied to the electrostatic emitting device 68 and the gap distance between the ream of paper 64 and the bottom of the electrostatic emitting device 68 can be adjusted by the machine operator to control the static charges that hold the ream together. A metal support plate 70, over which the conveyor belt 66 moves, is connected to ground potential (earth) to maximize static charging by the electrostatic emitting device 68. A power pack 72 is connected to the existing house power line 74 (usually 120 or 220 Volts AC) and provides an adjustable (up to 25,000 Volts, 8 mA) voltage of positive polarity to the emitter points on the electrostatic emitting device 68. For optimum results, the air gap between top of ream 64 and bottom of the electrostatic emitting device 68 is between ½" and 1"; although acceptable results can also be achieved with somewhat greater air gaps provided the ream 64 being destacked is thinner and/or the operating voltage of the electrostatic emitting device 68 is increased. Typically, one can work with a voltage of 16,000 Volts when the gap is about 1" and the ream thickness is about 6", or when the gap is about 4" and the ream thickness is only 4". A 6" thick ream would require approximately 20,000 Volts when the gap is increased to about 4" and approximately 24,000 Volts when the air gap is increased to about 7". The computer controller can be used to automatically adjust both the gap and the voltage to achieve optimum results.

Directing this electrostatic force 71 of positive polarity toward the top of the ream of paper 64 being destacked and against the grounded plate 70 below the conveyor belt 66 balances the negative electrostatic charge existing between the layers of paper (described above) and thereby eliminates the pre-existing repelling force, and the positive charge 71 being applied from the electrostatic emitting device 68 through the ream of paper 64 toward the grounding plate actually causes the individual layers of paper to attract each other and to temporarily bond the sheets together. This electrostatic bonding force will diminish with time until the deliberately induced excessive charges are again at their natural neutral level. The time to again reach this natural level varies from somewhat less than one hour to several days but is of more than sufficient duration to hold the reams or stacks of paper together during the processing and packaging operations.

Referring again to FIG. 3, after the conveyor 66, the reams of paper 64 then flow into a squaring station 76, on through inspection stations at numerals 78 through 88 and into a cartonizing machine 90 where a bottom carton is formed around the ream and so is a top lid. Once the skid load 40 is emptied, an empty skid removal device 92 removes the empty skid from the destacker 54.

Typically, reams of 500 sheets, each up to 0.012" thick (total of 6" thick pack) can retain the electrostatic holding effect long enough to process the ream through the entire machine until the finished and sealed cartons are palletized. The holding charge does diminish with time so that the sheets will no longer cling together when the printer receives the cartons of paper for further processing.

Although the above specifically describes the intentional use of electrostatic charges to eliminate undesired sliding around of the uppermost sheets of paper on skid loads being destacked into reams for cartonizing, the method of this invention can be also used to eliminate problems with the upper sheets of paper sliding around on thinner stacks or packs of paper that are automatically moved from the batch counter delivery end of a sheeter for other types of further processing. Typical applications are on machines that automatically produce and package products such as loose leaf filler sheets, spiral bound notebooks, steno pads, memo pads, and the like. In each such case, the paper is unwound from one or more mill rolls, printed, perforated or otherwise improved and then cut into sheets which are collected in batches of predetermined count and then finished in-line. The in-line finishing operations may consist of punching file holes, applying front and back cover sheets, spiral binding or padding, wrapping and/or cartonizing. As the stacks or packs are being formed and batched, the same electrostatic charges of negative polarity described above are on both sides of each sheet in the stack or pack. As the collated sets, packs, stacks, or reams are automatically pushed from the collecting tray toward the finishing end of the processing line, the individual sheets want to slide around because the entrapped air and the electrostatic forces of equal polarity do not allow intimate contact and friction between those layers of paper. Deliberately forcing an electrostatic charge of positive polarity by the method of this invention into the negatively charged sheets of paper will temporarily hold the individual packages of sheets together during the finishing operations and permit increased production speeds by eliminating disturbances from the undesired sliding around of sheets.

Thus, it can be seen from the foregoing specification and attached drawings that the method and apparatus of the present invention provides a unique means for causing intimate contact between adjacent sheets of paper in a stack thereby eliminating undesirable slippage.

The preferred embodiment described above admirably achieves the objects of the invention; however, it will be appreciated that the departures can be made by those skilled in the art without departing from the spirit and scope of the invention which is limited only by the following claims.

What is claimed is:

1. A method using electrostatic charges to temporarily hold sheets of paper in assembly, comprising:

providing means for producing a stack of sheets of paper, utilizing said stack producing means to produce a stack of sheets of paper so that the sheets in said stack have an electrostatic charge introduced thereon which tends to repel said sheets from adjacent sheets in said stack and so that, in addition, at least some of said sheets in said stack have a layer of air between adjacent sheets whereby the electrostatic forces and layers of air cause adjacent sheets to slide relative to one another if the stack is moved; and introducing an opposite electrostatic charge into at least an upper portion of said stack, said opposite electrostatic charge having an opposite polarity to the repelling electrostatic charge on said sheets thereby causing sheets in the upper portion of the stack to no longer repel one another thereby decreasing the tendency of the sheets in the upper portion of said stack to slide relative to one another if the stack is moved.

2. The method in accordance with claim 1, wherein said utilizing step comprises the steps of:

A. providing a first sheet of paper;

B. introducing an electrostatic charge on said sheet of paper;

C. moving said sheet of paper into a stack assembly area;

D. providing a second sheet of paper;

E. introducing an electrostatic charge of the same polarity as the electrostatic charge of step B on said second sheet;

F. moving said second sheet into said stack assembly area on top of said first sheet thereby trapping a layer of air between said first and second sheets; and G. repeating steps A through F to create said stack of paper with the weight of the upper sheets of paper in the stack forcing the layers of air from between the lower sheets of paper whereby the lower sheets in the stack achieve intimate contact while the upper sheets tend to slide relative to one another if the stack is moved because of the like electrostatic charges thereon and the layers of air therebetween.

3. The method in accordance with claim 2, wherein said providing steps A and D include severing said first and second sheets from an endless web.

4. The method in accordance with claim 2, wherein said introducing steps B and E include movement of said first and second sheets through conveyors which introduce said electrostatic charges.

5. The method in accordance with claim 4, wherein said electrostatic charges are negative charges.

6. The method in accordance with claim 5, wherein said step of introducing an opposite electrostatic charge into at least an upper portion of said stack includes the introduction of positive charges onto the upper sheets in the stack while maintaining the negative charges on the lower sheets.

7. The method in accordance with claim 1, wherein said utilizing step includes:

assembling said stack of sheets of paper so that, as said stack is assembled, each sheet has an electrostatic charge introduced thereon which tends to repel said sheet from adjacent sheets in said stack and, in addition, a layer of air is introduced between adjacent sheets whereby the electrostatic forces and layers of air cause adjacent sheets to slide relative to one another if the stack is moved.

8. An apparatus using electrostatic charges to temporarily hold sheets of paper in assembly, comprising:

means for producing a stack of sheets of paper so that the sheets in said stack have an electrostatic charge introduced thereon which tends to repel said sheets from adjacent sheets in said stack and, in addition, so that at least some of said sheets in said stack have a layer of air between adjacent sheets whereby the electrostatic forces and layers of air cause adjacent sheets to slide relative to one another if the stack is moved; and means for introducing an opposite electrostatic charge into at least an upper portion of said stack, said opposite electrostatic charge having an opposite polarity to the repelling electrostatic charge on said sheets thereby causing sheets in the upper portion of the stack to no longer repel one another thereby decreasing the tendency of the upper portion of the sheets to slide relative to one another if the stack is moved.

9. The apparatus in accordance with claim 8, wherein said opposite charge introducing means includes an electrostatic charging bar.

10. The apparatus in accordance with claim 8, wherein said producing means includes means for assembling a stack of sheets of paper so that, as said stack is assembled, each sheet has an electrostatic charge introduced thereon which tends to repel said sheet from adjacent sheets in said stack and, in addition, a layer of air is introduced between adjacent sheets whereby the electrostatic forces and layers of air cause adjacent sheets to slide relative to one another if the stack is moved.

11. The apparatus in accordance with claim 10, wherein said opposite charge introducing means includes an electrostatic charging bar.

12. The apparatus in accordance with claim 10, wherein said assembling means includes means to sever individual sheets from an endless web.

13. The apparatus in accordance with claim 12, wherein said sheets move along a conveyor which introduces said repelling charge to said sheets.

14. The apparatus in accordance with claim 13, wherein said conveyor includes upper and lower belt sections which interact with said sheets to introduce said repelling charge thereto.

15. The apparatus in accordance with claim 10, wherein each of said sheets moves along a conveyor which introduces said repelling charge to said sheets.

16. The apparatus in accordance with claim 15, wherein said conveyor includes upper and lower belt sections which interact with said sheets to introduce said repelling charge thereon.

* * * * *